US009096349B2

(12) United States Patent
Youell et al.

(10) Patent No.: US 9,096,349 B2
(45) Date of Patent: Aug. 4, 2015

(54) DIVIDER BOXES AND THEIR ASSEMBLY

(71) Applicant: American Corrugated Products, Inc., Columbus, OH (US)

(72) Inventors: D. Rudolph Youell, Dublin, OH (US); Aaron Spencer, Gove City, OH (US); Michael Fisco, Columbus, OH (US)

(73) Assignee: DRYIP, LLC, Columbus, OH (US)

( * ) Notice: Subject to any disclaimer, the term of this patent is extended or adjusted under 35 U.S.C. 154(b) by 0 days.

(21) Appl. No.: 14/093,763

(22) Filed: Dec. 2, 2013

(65) Prior Publication Data

US 2014/0263351 A1 Sep. 18, 2014

Related U.S. Application Data

(60) Provisional application No. 61/790,931, filed on Mar. 15, 2013, provisional application No. 61/810,036, filed on Apr. 9, 2013, provisional application No. 61/810,057, filed on Apr. 9, 2013.

(51) Int. Cl.

| | |
|---|---|
| ***B65D 25/04*** | (2006.01) |
| ***B65D 5/49*** | (2006.01) |
| *B65D 5/32* | (2006.01) |

(52) U.S. Cl.

CPC ..... *B65D 25/04* (2013.01); *B65D 5/48038* (2013.01); *B65D 5/324* (2013.01); *B65D 2571/00716* (2013.01)

(58) Field of Classification Search

USPC ..... 220/4.21, 4.24, 507, 520, 528, 529, 220/533, 552; 229/103.2, 120.06, 120.24, 229/120.25, 120.26, 120.36, 122.21, 164.1, 229/198.2

See application file for complete search history.

(56) References Cited

U.S. PATENT DOCUMENTS

| | | | | |
|---|---|---|---|---|
| 449,330 | A * | 3/1891 | Perkins | 217/30 |
| 2,448,795 | A * | 9/1948 | Grecco | 229/120.012 |
| 2,706,935 | A * | 4/1955 | Pasjack | 493/91 |
| 3,942,709 | A | 3/1976 | Gepfer | |
| 5,785,239 | A | 7/1998 | Campbell, II et al. | |
| 6,669,082 | B1 * | 12/2003 | Meyer | 229/120.36 |
| 6,814,232 | B1 * | 11/2004 | Morris et al. | 206/400 |
| 7,455,214 | B2 * | 11/2008 | Miller et al. | 229/101 |
| 7,775,419 | B2 | 8/2010 | Bale | |

FOREIGN PATENT DOCUMENTS

| | | | | |
|---|---|---|---|---|
| WO | WO-2011/010242 A1 * | 1/2011 | | B65B 5/02 |

* cited by examiner

*Primary Examiner* — Anthony Stashick
*Assistant Examiner* — Mollie Llewellyn
(74) *Attorney, Agent, or Firm* — Standley Law Group LLP

(57) ABSTRACT

A divider box contains a plurality of individual compartments, i.e, a crate, formed from mated slotted transverse panels and slotted longitudinal panels. A pair of horizontal exterior panels surmount the interlocking panels forming the divider box outside. A lid and tray complete the divider box.

11 Claims, 3 Drawing Sheets

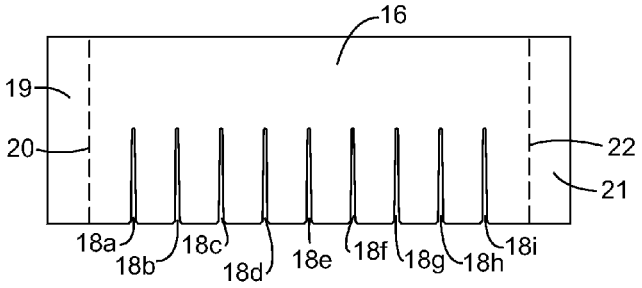
FIG. 3
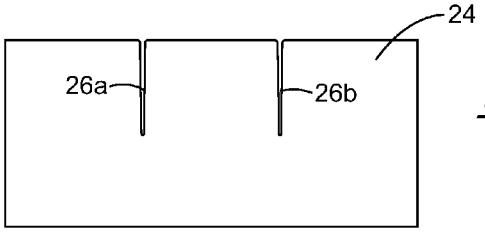
FIG. 4
FIG. 5
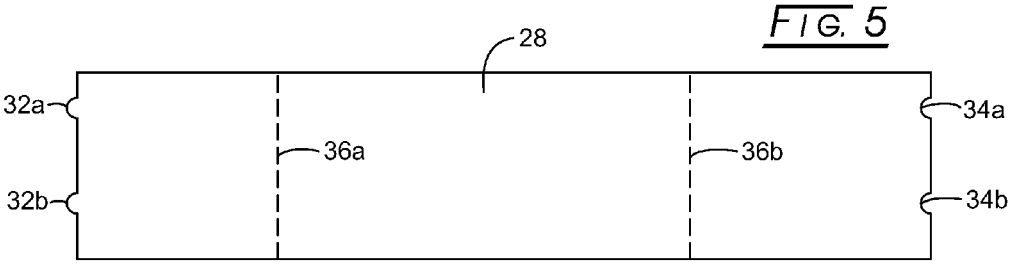
FIG. 6
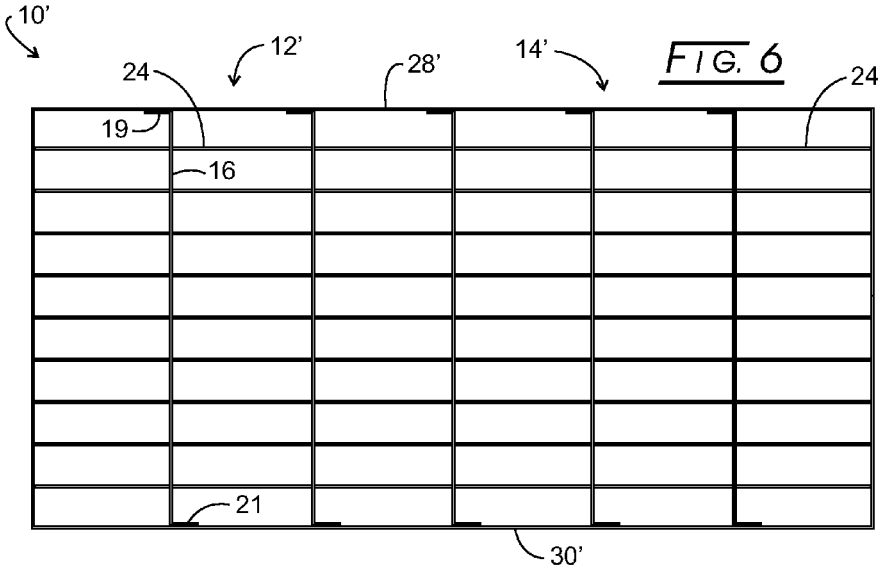

DIVIDER BOXES AND THEIR ASSEMBLY

CROSS-REFERENCE TO RELATED APPLICATIONS

This application claims benefit of U.S. provisional applications 61/790,931, filed Mar. 15, 2013; 61/810,036, filed Apr. 9, 2013; and 61/810,057, filed Apr. 9, 2013; the disclosures of which are expressly incorporated herein be reference.

STATEMENT REGARDING FEDERALLY SPONSORED RESEARCH

Not applicable.

BACKGROUND

The present disclosure relates generally to paperboard containers, and more particularly to divider box and assembly.

Existing divider systems are primarily for providing internal dividers within the box container perimeter. The dividers may be formed of interlocking sheets. The interlocking sheets commonly comprise interior divided cells, and perimeter cells that are open around the perimeter of the divider. Alternatively, interlocking divider partitions do not delineate a complete perimeter cell, but provide for an abbreviated perimeter cell that functions as an air cell around the perimeter of the divider.

These perimeter air cells result in a waste of a significant portion of the box container volume, and add weight to the divider system that does not provide for additional item cells. In addition, heavy items carried in the interior cells may shift and collapse the perimeter air cells, allowing additional shifting of the contents of the box container. Shifting can cause impact damage or lead to the collapse of a stack of box containers.

In view of the foregoing, it is apparent that alternatives to the interlocking divider systems known in the art would improve efficiency in the shipping and manufacturing industries.

Broad Statement

A divider box contains a plurality of individual compartments. The divider box includes a series of substantially parallel transverse panels. Each transverse panel having a top edge, a bottom edge, and a pair of side edges. The transverse panels have a series of slots extending from the bottom edge of each transverse panel upwardly. Each transverse panel has a folded tab at each side edge thereof. The divider box also includes a series of substantially parallel longitudinal panels. Each longitudinal panel has a top edge, a bottom edge, and a pair of side edges. The transverse panels have a series of slots extending from the top edge of each transverse panel downwardly. The transverse panels and the longitudinal panels are perpendicularly disposed with the transverse panel slots being placed within the longitudinal panel slots to create a crate of individual compartments. The divider box also has at least a pair of exterior panels. Each exterior panel has a top edge, a bottom edge, and a pair of side edges. The exterior panels have at least a pair of tabs at one side edge and at least a pair of mating recesses on the opposite side edge. Each panel has at least 1 vertical fold line. The exterior panels surmount the crate for forming an outside of the divider box. Each folded transverse panel tab is joined to the exterior panels and the exterior panel tabs and recesses are mated. The divider box is completed by having a lid and a bottom tray.

BRIEF DESCRIPTION OF THE DRAWINGS

For a fuller understanding of the nature and advantages of the present method and process, reference should be had to the following detailed description taken in connection with the accompanying drawings, in which:

FIG. 3 is a plan view of a longitudinal locking panel;

FIG. 4 is a plan view of a lateral locking panel;

FIG. 5 is a plan view of an exterior wrapping panel;

FIG. 6 is a top view of the divider box assembly of FIG. 1;

The drawings will be described in further detail below.

DETAILED DESCRIPTION

The disclosed divider box assembly is useful in shipping individual component parts in individual compartments so as to prevent damage by the parts, for example, by bumping against each other during shipment. The disclosed divider box assembly can be shipped in a relatively flat, folded down configuration and then unfolded at the plant for stuffing with parts. The entire volume of the divider box is used for storing component parts inasmuch as compartments fill the entire interior volume of the divider box.

Figure 1:
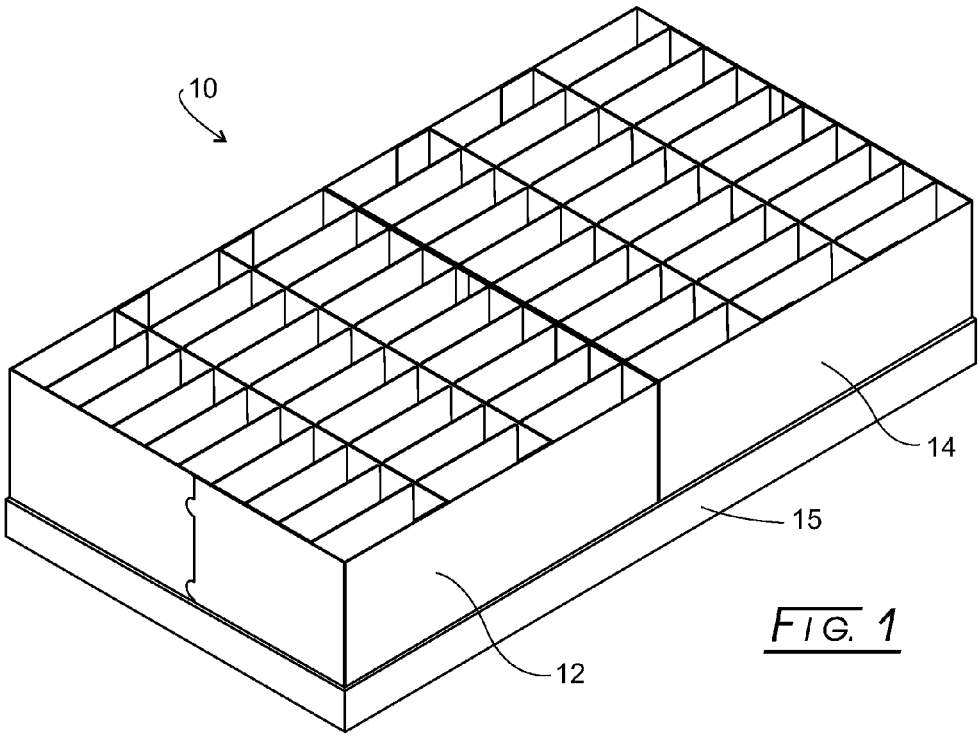
FIG. 1 is an isometric view of the disclosed divider box assembly formed from a pair of divider boxes.
Figure 2:
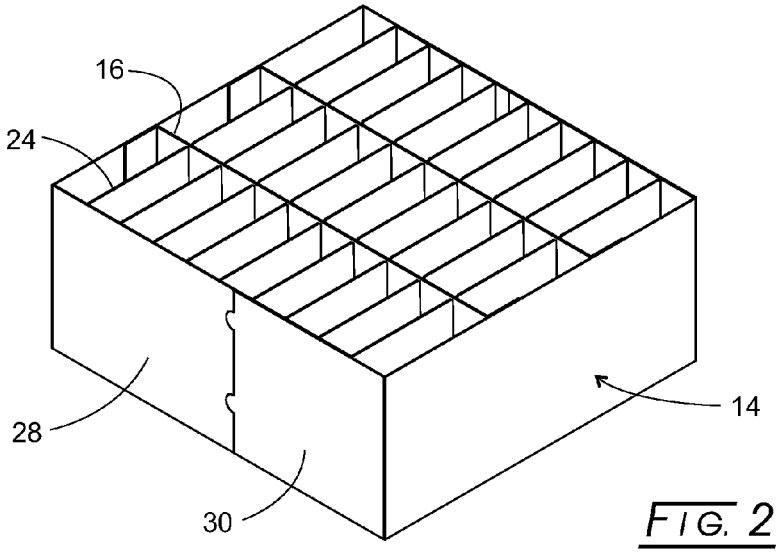
FIG. 2 is an isometric view of a disclosed divider box, such as is used for forming the divider box assembly of FIG. 1.

Referring initially to FIGS. 1 and 2, a divider box assembly, 10, is seen in FIG. 1 to be composed of two divider boxes, 12 and 14, divider box 14 being shown in FIG. 2. Each divider box 12 and 14 is seen to have 30 individual compartments for stuffing with the same or different component parts for shipment. Such number of compartments is by way of illustration and not limitation.

Referring additionally to FIGS. 3, 4, and 5, each divider box 12 and 14 is formed by a series of panels, 16, (FIG. 3) that each have a series of slots, 18*a*-18*i*, running up from the bottom of panel 16 upwardly to about the midpoint of the height thereof. Fold lines, 20 and 22, run from top to bottom close to each side edge of panel 16 forming end tabs, 19 and 21, respectively.

A second panel, 24, (FIG. 4) has a pair of downwardly projecting slots, 26*a*-26*b*, running from the top edge of panel 24 to about its midpoint. The number of slots 18*a*-18*i* and 26*a*-26*b* could be in greater or fewer number than that shown in the drawings. Importantly, however, slots 18*a*-18*i* and 26*a*-26*b* cooperate for mutual insertion when panels slots 18*a*-18*i* and 26*a*-26*b* are placed at right angles to each other to form the individual compartments shown for divider boxes 12 and 14. The number of individual compartments for each divider box also is a matter of choice and can be fewer or greater than that shown in the drawings.

Referring additionally to FIGS. 5 and 6 where prime numbers indicate similar parts described with reference to FIGS. 1-4 above, panels 16 and 24 are seen in position forming individual compartments. Surmounting the series of panels and forming the outside of the disclosed divider box is a pair of exterior panels, typified by panels, 28' and 30' (see FIG. 2). Panels 28' and 30' have a pair of tabs, 32*a* and 32*b*, on one end and a pair of mating recesses, 34*a* and 34*b*, on the other end. Each panel also has a pair of fold lines, 36*a* and 36*b*, running from top to bottom of each panel, the distance therebetween determining the lateral dimensions of each divider box.

Tabs and recesses of panels 28' and 30' are placed in a mating relationship and affixed to an end of panel 16 or a similar such panel, such as by adhesive, tape, bands, or other convenient mechanism. Depending on the number of compartments desired, more than 2 panel 28's may be required to form the outside of the divider box. Thus, the number of fold lines for panel 28' may need to be adjusted accordingly.

Each panel 16 will have the ends folded over to be similarly adhered to panel 28' or 30' by adhesive, tape, or other mechanism (see FIG. 6). The process, then, is repeated for forming all of the compartments and outside of each divider box. FIGS. 1 and 6 show a divider box assembly where two divider boxes have been joined together for forming the assembly.

Figure 7:
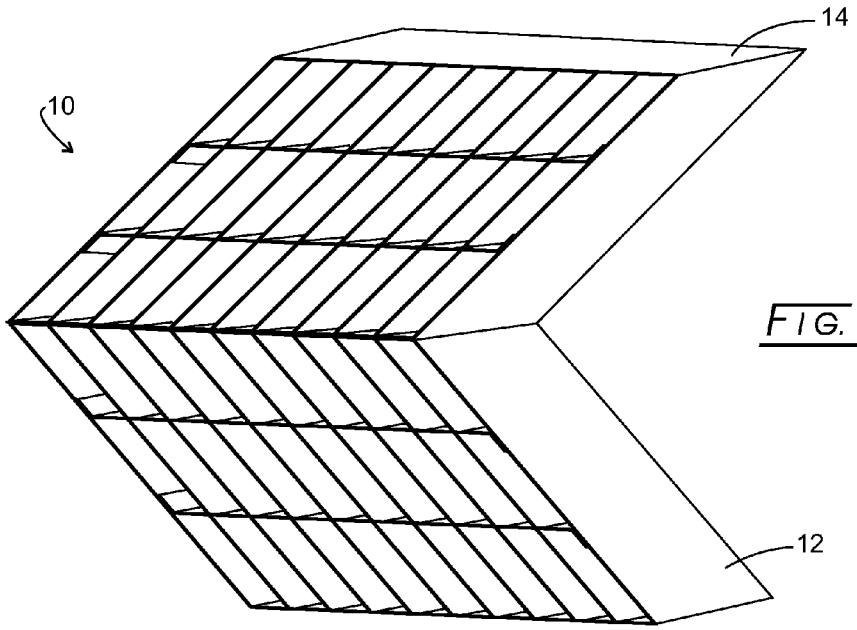
FIG. 7 is an isometric view of the divider box assembly of FIG. 1 starting to be folded about its center.
Figure 8:
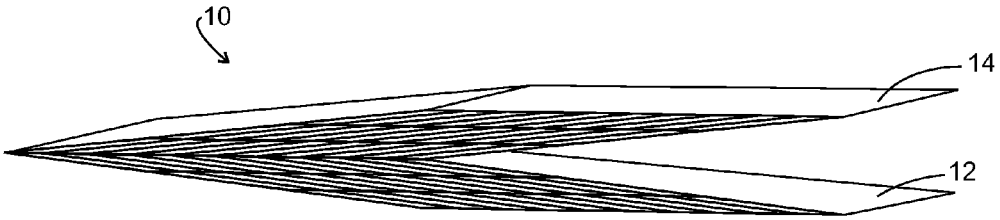
FIG. 8 is an isometric view of the divider box assembly of FIG. 7 almost completely folded.
Figure 9:
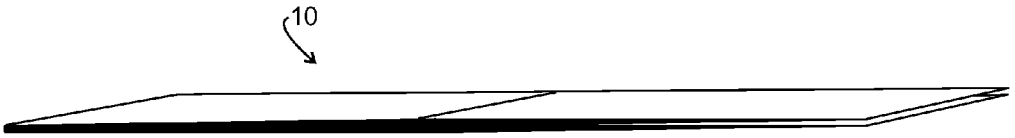
FIG. 9 is an isometric view of the divider box assembly of FIG. 7 being folded down for shipment.

One of the unique features of the disclosed divider boxes is their ability to fold flat for shipment from their place of manufacture to the plant for use. Referring now to FIGS. 7, 8, and 9, each divider box 28 and 30 have folded about their joining, as seen in FIG. 7. Such folding is continued, as in FIG. 8, until the assembly is flat, as seen in FIG. 9. Each divider box 28 and 30 also has been folded flat; thus, making shipment of each divider box and their assembly take up much less space.

Upon reaching the plant for use, the process shown in FIGS. 7-9 is reversed until the assembly shown in FIG. 1 is reached. Referring again to Fig. 1, a lid/base, 15, is shown. Such lid/base 15 can be placed under each divider box for forming a base and atop each divider box for forming a lid. Each lid/base can be affixed by adhesive, tape, metal slats, or the like for retaining the component parts securely in each divider box.

Materials of construction for forming the divider boxes can be a paperboard or corrugated paperboard material, such as, for example, cardboard, pasteboard, fiberboard, corrugated plastic sheets, or the like. However, any recyclable material having the necessary strength and rigidity for the particular application envisioned is suitable. As to the preferred paperboard materials, it will be appreciated that the wall construction thereof, i.e., single-ply, double-ply, or higher, may be varied depending upon the application. The divider boxes and divider box assemblies will be described in particular reference to the use of corrugated paperboard; however, such description is illustrative and not a limitation on the present disclosure.

While the divider boxes have been described with reference to various embodiments, those skilled in the art will understand that various changes may be made and equivalents may be substituted for elements thereof without departing from the scope and essence of the disclosure. In addition, many modifications may be made to adapt a particular situation or material to the teachings of the disclosure without departing from the essential scope thereof. Therefore, it is intended that the divider box not be limited to the particular embodiments disclosed. Also, all citations referred herein are expressly incorporated herein by reference.

We claim:

1. A divider box assembly containing a plurality of individual compartments, which comprises:

a) a series of substantially parallel transverse panels, each transverse panel having a top edge, a bottom edge, and a pair of side edges, said transverse panels having a series of slots extending from said bottom edge of each transverse panel upwardly, each transverse panel having a folded tab at each said side edge thereof;

b) a series of substantially parallel longitudinal panels, each longitudinal panel having a top edge, a bottom edge, and a pair of side edges, said transverse panels having a series of slots extending from said top edge of each transverse panel downwardly; said transverse panels and said longitudinal panels being perpendicularly disposed with said transverse panel slots being placed within said longitudinal panel slots to create a crate of individual compartments; and c) at least a pair of exterior panels, each exterior panel having a top edge, a bottom edge, and a pair of side edges, said exterior panels having at least one tab at one side edge and at least one mating recesses on the opposite side edge wherein said mated panel tabs and recesses of said pair of exterior panels being adhesively joined to a transverse panel fold tab, each panel having at least 1 vertical fold line, said exterior panels surmounting said crate for forming an outside of said divider box, each folded transverse panel tab being joined to said exterior panels, said exterior panel tab(s) and recess(es) being mated, wherein said divider box assembly is foldable such that two opposing side panels remain parallel to each other while being folded and a remaining first panel and second panel fold into substantially equal sections, the sections of the remaining first panel folding to contact each other and the sections of the remaining second panel folding about a portion of the transverse and longitudinal panels.

2. The divider box assembly of claim 1, wherein said transverse panels have 8 slots.

3. The divider box assembly of claim 1, wherein said longitudinal panels have 3 slots.

4. The divider box assembly of claim 1, which contains 60 compartments.

5. The divider box assembly of claim 1, formed from corrugate stock.

6. The divider box assembly of claim 2, which contains 60 compartments.

7. The divider box assembly of claim 5, wherein said longitudinal panels have 3 slots.

8. The divider box assembly of claim 1, wherein said transverse panel tabs are adhesively joined to an exterior panel.

9. The divider box assembly of claim 1, additionally comprising:

d) a lid; and e) a bottom tray.

10. The divider box assembly of claim 7, additionally comprising:

d) a lid; and e) a bottom tray.

11. The divider box assembly of claim 1, wherein said exterior panel tabs and recesses are in the shape of semicircles.

* * * * *